United States Patent [19]

Steadman

[11] Patent Number: 4,674,633

[45] Date of Patent: Jun. 23, 1987

[54] CONTAINER-RETAINING BOX

[75] Inventor: James M. Steadman, Phoeniz, Ariz.

[73] Assignee: Conagra, Inc., Omaha, Nebr.

[21] Appl. No.: 913,602

[22] Filed: Sep. 26, 1986

Related U.S. Application Data

[63] Continuation of Ser. No. 727,616, Apr. 29, 1985, abandoned, which is a continuation of Ser. No. 607,692, May 7, 1984, abandoned, which is a continuation of Ser. No. 432,040, Sep. 30, 1982, abandoned.

[51] Int. Cl.[4] ..... B65D 73/00

[52] U.S. Cl. ..... 206/491; 206/521; 206/557; 206/525; 229/40

[58] Field of Search ..... 206/45.14, 491, 521, 206/525, 557, 588, 590; 229/30, 31 R, 40

[56] References Cited

U.S. PATENT DOCUMENTS

| | | | |
|---|---|---|---|
| 2,163,045 | 6/1939 | Lavere | 206/491 |
| 2,904,170 | 9/1959 | Hennessey et al. | 206/525 |
| 3,281,051 | 10/1966 | O'Brien et al. | 206/491 |
| 3,385,502 | 5/1968 | Pilger | 206/491 |
| 3,411,696 | 11/1968 | Ayer et al. | 206/491 |
| 3,586,163 | 6/1971 | Loehrer | 206/491 |
| 3,606,134 | 1/1971 | Engle | 229/23 R |
| 3,618,848 | 11/1971 | Pawlowski | 206/557 |
| 3,637,404 | 1/1972 | MacManus | 206/491 |
| 3,705,681 | 12/1972 | Rossi et al. | 206/491 |
| 3,765,529 | 10/1973 | Mueller | 206/557 |
| 4,313,540 | 2/1982 | Hart et al. | 206/588 |

*Primary Examiner*—Joseph Man-Fu Moy
*Assistant Examiner*—David T. Fidei
*Attorney, Agent, or Firm*—Willian Brinks Olds Hofer Gilson & Lione Ltd.

[57] ABSTRACT

The invention is an open-ended package for an article comprising a sleeve of generally rectangular cross-section. Resiliently hinged tabs are provided for retaining the article within the sleeve. The tabs are positioned so that their hinge lines are adjacent and perpendicular to the external edge of the panel to which it is hinged. The tabs are of a length greater than the depth of the sleeve. As a result, when the tabs are bent into the interior of the sleeve in an over-center position, they press toward the opposite panel of the sleeve and are thereby retained in a position traversing the open end of the sleeve so as to effect retention of the article in the package.

3 Claims, 7 Drawing Figures

FIG. 1
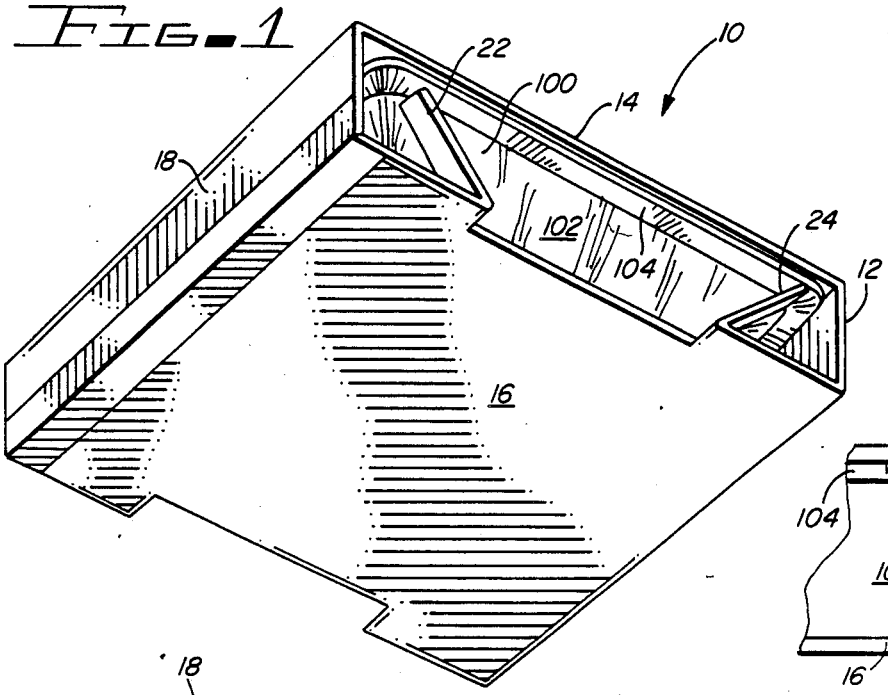
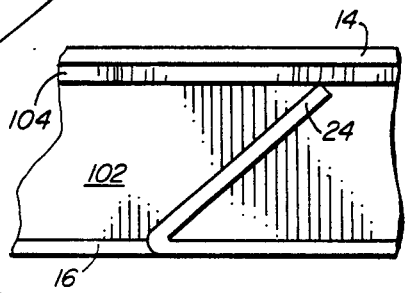
FIG. 7
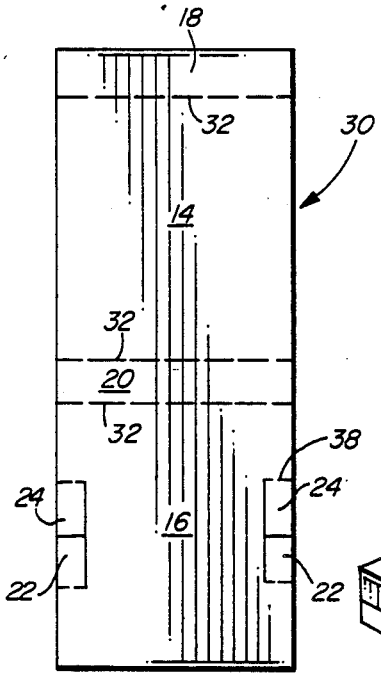
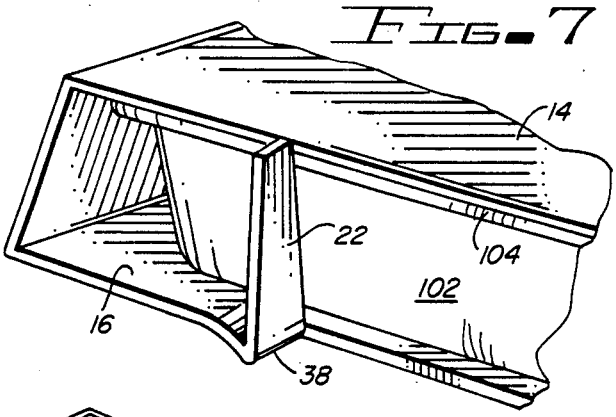
FIG. 6
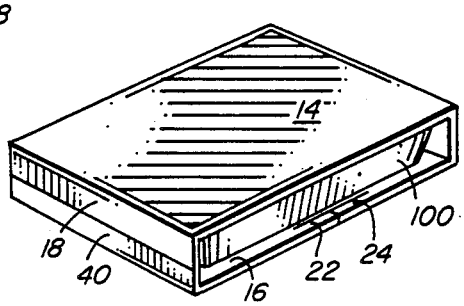
FIG. 2
FIG. 4
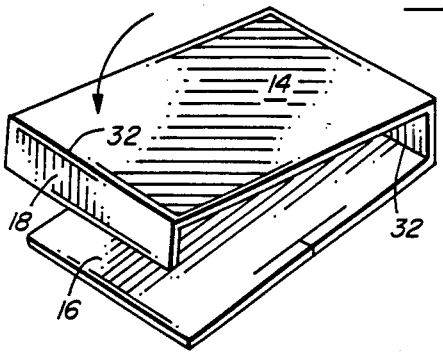
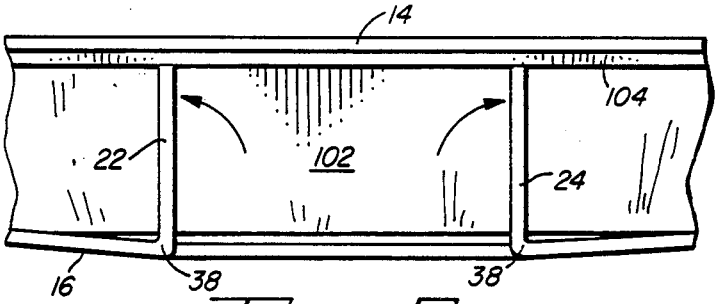
FIG. 3
FIG. 5

CONTAINER-RETAINING BOX

This application is a continuation of application Ser. No. 432,040 filed Sept. 30, 1982 which is a continuation of Serial No. 607,692, filed May 7, 1984 which is a continuation of Serial No. 727,616 filed Apr. 29, 1985, all of said applications now abandoned.

BACKGROUND OF THE INVENTION

1. Field of the Invention

This invention relates generally to packaging, and, more specifically, relates to a tubular, container-retaining package. The package combines flip-in-place tabs with the natural stiffness and resilience of the package material to lock the container within an open-ended package.

2. Description of the Prior Art

In the past, packages were widely used to house and protect goods. Among the most common of packages was the rectangular "cardboard box". Cardboard was a structure formed by layers of paperboard, with the middle layer most typically lying in a corrugated configuration. The cardboard material was sturdy and durable, and the rectangular shape permitted the packages to be easily stacked.

High costs made material reduction a desirable goal. Despite the substantial efforts expended over the years, a need still existed for packages which required less material.

To protect and house an article, the package normally had to retain the article. The common "cardboard box" employed a paperboard panel adjacent each side of the enclosed article, and thereby fully enclosed the item within.

Recognizing the possible material savings over a full six-sided box, open-ended boxes were introduced. However, an additional method or structure was required to prevent the escape of the housed item through the open ends of the container. Glued flaps, staple-secured flaps, tape fasteners, or an over-pack, such as a "shrink-wrap", were all common approaches to securing an item within an open-ended box. Since each of these alternatives required additional materials and/or added operations to assemble the package, a need continued for an open-ended box which didn't require any added fasteners or wrappings, and which required minimal, if any, additional effort to secure the item within.

BRIEF DESCRIPTION OF THE DRAWING

FIG. 1 is a perspective elevational view of the lower side of an improved package.

FIG. 2 is a plan view of the blank for the package of FIG. 1.

FIG. 3 shows the assembly of the blank of FIG. 2.

FIG. 4 is a perspective view, showing an article loaded in the assembled-blank of FIG. 3.

FIG. 5 is an enlarged elevational detail, showing a method for securing the article within the package.

FIG. 6 is an enlarged perspective detail, showing an alternate method for securing the article within the package.

FIG. 7 is an enlarged elevational view of one of the locking tabs of the package.

SUMMARY OF THE INVENTION

The invention is a package which employs flip-in-place, or snap-in-place, tabs to secure the housed item by latching in an over-center condition.

In accord with a broadest aspect of the invention, it is an object to provide an improved article-retaining package that requires a minimum of material.

It is another object to provide an improved open-ended sleeve for easily securing an item within.

DESCRIPTION OF THE PREFERRED EMBODIMENTS

In accord with one embodiment of this invention, a package for an article is disclosed, comprising a sleeve with a first and second panel and side panels defining a cavity of generally rectangular cross-section and of sufficient depth and width to receive the article. The sleeve further comprises an open end comprised of the external edges of the panels. At least one tab is resiliently hinged at the second panel and positioned so that the hinge line is adjacent to and substantially perpendicular to the external edge of the second panel. In addition, the tab has a length greater than the depth of the sleeve. As a result, when the tab is bent into the interior of the sleeve, the tab becomes latched in an over-center condition with the resilience of the hinge pushing the tab toward the first panel. When thus latched, the tab functions to block passage of the article through the open end and thereby retains the article in the cavity of the sleeve.

In accord with another embodiment of the invention, a package for an article is disclosed where a plurality of tabs are hinged at one or more panels of the sleeve.

In accord with still another embodiment of the invention, a package for an article is disclosed where the article is of a tray-type construction having a rim running around the periphery of its top; and the tabs as described above press against the under surface of the rim of the tray-type article.

In accord with yet another embodiment of the invention a package for an article is disclosed which package is made of B-flute corrugated paperboard so that the corrugations thereof lie parallel to the length of the tabs.

THE SPECIFICATION

FIG. 1 is a perspective elevational view of the lower side of an improved package, as shown generally by reference number 10. The package 10 is arranged to house an article 100. As illustrated, the article 100 includes a body 102 and a rim 104. The rim 104 projects beyond an exposed side-face of the body 102.

The package 10 includes an open-ended sleeve 12. Referring also to FIG. 2, it can be seen that the sleeve 12 is formed by an first panel 14, a second panel 16 and side panels 18, 20. Locking tabs 22, 24 are formed from the material of the second panel 16, in opposed pairs adjoining the open ends of the sleeve 12. Depending upon their position, the locking tabs 22, 24 can either retain or release the article 100 with respect to the package 10.

An "upper", or first, surface of the article 100 rests against the interior face of the first panel 14. A "lower", or second, surface of the article lies at the opposite face of the article 100. As illustrated best in FIG. 1, the "lower" or second surface of the article is actually formed by the combination of the lower plane of the body 102 and the lower surface of the rim 104.

In FIG. 2, reference number 30 generally identifies a "blank", from which the package 10 is formed. The blank 30 is cut from a planar sheet of resilient, but relatively stiff, material. In the preferred embodiment, intended to house five or six pounds of frozen food in a foil-covered steam-table tray, the blank 30 is cut from "200 pound B-flute corrugated paperboard".

Edge scores 32 delineate the upper and lower panels 14, 16, and thereby also define the attached side panels, 18, 20. Cuts through the cardboard define the tabs 22, 24 from the lower-panel portion of the blank 30. The corrugations of the paperboard lie parallel to the length of the tabs 22, 24, contributing to the columnarity and beam-section of the tabs 22, 24. Tab scores form hinges 38, which run across the corrugations at the base of the tabs 22, 24, defining a resilient hinged connection between the tabs 22, 24 and the lower panel 16. The hinges 38 are scored so that the hinge lines are substantially perpendicular to the edge of the second panel 16, at the open end thereof.

FIG. 3 illustrates a step in the assembly of the sleeve 12 from the blank 30. The blank 30 is folded, in the direction shown by the arrow, about the edge-scores 32. The side panel 18 is pivoted into position next to the lower panel 16. As shown more fully in FIG. 4, the sleeve 12 is formed by fastening the free end of the side panel 18 to the lower panel 16 with a strip of tape 40. Thus, forming the sleeve 12 from the blank 30 requires only a single connection. Other fasteners, such as adhesives or staples, will suggest themselves to those skilled in the art.

FIG. 4 shows the article 100 loaded within the sleeve 12, having been slid-in-place through the open end of the sleeve 12. The article 100 is positioned within the sleeve 12 so that the respective opposed pairs of the tabs 22, 24 flank the body 102 of the article 100.

FIG. 5 is an enlarged elevational view of the tab-region of the package 10. The location and length of the tabs 22, 24 causes the tab-ends to contact the lower side of the rim 104 when the tabs 22, 24 are rotated "upward", as shown by the arrows, about the hinges 38. By slightly deforming the plane of the lower panel 16, sufficient clearance can be gained to permit the movable ends of the tabs 22, 24 to just pass "beneath" the lower surface of the rim 104 of the article 100. The columnarity and beam-section of the tabs 22, 24 are maintained even though the lower panel 16 is slightly deformed.

FIG. 6 illustrates an alternate approach to rotating a typical one of the tabs 22, 24 past the lower surface of the article rim 104. As the tabs 22, 24 are rotated "upward" about the hinges 38, the end-portions of the tabs 22, 24 are bent or "flipped" outward, around both the rim 104 and the edge of the upper panel 14. In this manner, the hinge 38 and the immediately connected region of the bottom panel 16, are partially deformed to allow the end of the tab 22 to swing "out" and "around" the edge of the top panel 14.

As shown in FIGS. 1 and 7, the rotation of the tabs 22, 24 is continued until they reach an "over-center" position with respect to the lower surface of the article 100. The ends of the tabs 22, 24 hook "under" the rim 104. In the "over-center" position, the resilient character of the corrugated blank-material tends to return the tabs 22, 24 toward their original planar position, but the interference with the rim 104 locks the tabs 22, 24 in place. When located in the "over-center" position, the tabs 22, 24 can be laterally displaced only by tearing the corrugated material forming the hinge 38, or by again manually displacing the ends of the tabs 22, 24 around the edge of the rim 104. Thus, once placed in the "over-center" position, the tabs 22, 24 trap and secure the article 100 within the package 10.

FIG. 7 also makes apparent the fact that a single tab 24 could be employed to lock the article 100 in place within the package.

The pairs of tabs 22, 24 are respectively located at the opposed ends of the package 10. By appropriately defining the distance between the inner edges of the pairs of tabs 22, 24, the article 100 can be positively located within the package 10. With the opening between the corresponding pairs of the tabs 22, 24 being slightly less than the width of the article body 102, the tabs 22, 24 are loaded against the exposed outer faces of the body 102 of the article 100. The interference fit and the resilient character of the corrugated material combine to positively position the article 100 in the midst of the package 10.

In the alternative, the tabs 22, 24 could be positioned so that the tab-ends miss the article 100 entirely. Thus, when the tabs 22, 24 are swung about their hinged connections to the second panel 16, the ends of the tabs 22, 24 meet interference from only the inner face of the first panel 14. By again bending or "flipping" the tabs 22, 24 past the outer edge of the first panel 14, the tabs 22, 24 can be brought to rest in the "over-center" condition. Again, the tabs 22, 24 are trapped in position by the first panel 14, and the article 100 is accordingly secured within.

As a further alternative, the tabs 22, 24 could be positioned to permit tab-ends to bear directly upon the lower surface of the article body 102. By providing a stepped end (not shown) on the tabs 22, 24, the shorter step can bear against the lower face of the article 100 and thereby provide a similar "over-center" locking action. In this configuration, the article 100 would be spaced from the inner surface of the lower panel 16 and the resilient hinge 38 would press the article 100 "upward" against the inner face of the upper panel 14. The resilience of the hinges 38 can also press the extended step-portion of each of the tabs "inward" against the exposed face of the body 102 of the article 100. This positively locates the article, and prevents lateral shifts of the article 100.

The package 10 is used by first cut-forming the blank 30, as shown in FIG. 2. The blank 30 is formed into a sleeve 12, as shown in FIGS. 3 and 4. The article 100 is then inserted into the formed sleeve 12. The tabs 22, 24 on both ends of the sleeve 12 are swung into position, as shown in FIGS. 5 and 6, to lock the article 100 within the package 10, as shown in FIGS. 1 and 7.

The advantage of the package 10 is clear. In its simplest embodiment, the package 10 requires a minimum of expensive material, requires no more than one assembly connection, and can retain an article without need for additional flaps, fasteners, or overpacking. Loading the package 10 is a quick and simple manual operation. The tabs 22, 24 securely position and hold the article 100 within the package 10. Removal of the article 100 is also an easy exercise, requiring only that one pair of the tabs 22, 24 be bent down to permit the article 100 to slide through an open end of the sleeve 12.

While the invention has been particularly shown and described with reference to preferred embodiments thereof, it will be understood and appreciated by those skilled in the art that changes in form and detail may be made in the described structure and method without departing from the spirit and scope of the invention.

I claim:

1. A package for an article having depth and width, comprising:

an open-ended sleeve, defining a cavity of generally rectangular cross-section, and having a first panel, a second panel which is generally parallel to said first panel, side panels, and two open ends comprised of the external edges of said panels, said open ends being of sufficient depth and width to receive said article; and at least four tabs, each such tab having one end resiliently hinged at the second panel and an other end which is not attached to either panel, two of said tabs positioned such that the hinge line is adjacent and perpendicular to the external edge of said second panel at one of said open ends, another two of said tabs positioned such that the hinge line is adjacent and perpendicular to the external edge of said second panel at the other open end;

said tabs being of a length greater than the depth of said sleeve such that the article is locked within said cavity when said tabs are bent into the cavity in an over-center position thereby pressing the other ends of the tabs toward the first panel of said sleeve.

2. The package of claim 1, wherein said article has a rim at the periphery of its top, and each of said tabs is bent into the interior of said cavity in an over-center position so as to press said other end of each of said tabs against the under surface of the rim of said article.

3. The package of claim 1, wherein said sleeve is made of B-flute corrugated paperboard, the corrugations of said paperboard lying parallel to the length of said tabs.

* * * * *